United States Patent [19]

Scott

[11] Patent Number: 4,713,574

[45] Date of Patent: Dec. 15, 1987

[54] IGNITER ELECTRODE LIFE CONTROL

[75] Inventor: John C. Scott, Cincinnati, Ohio

[73] Assignee: The United States of America as represented by the Secretary of the Air Force, Washington, D.C.

[21] Appl. No.: 784,986

[22] Filed: Oct. 7, 1985

[51] Int. Cl.[4] ..... H01J 13/20

[52] U.S. Cl. ..... 313/130; 313/137; 313/144

[58] Field of Search ..... 313/130, 137, 143, 144

[56] References Cited

U.S. PATENT DOCUMENTS

| | | | |
|---|---|---|---|
| 2,272,558 | 2/1942 | Hall | 313/130 X |
| 2,786,158 | 3/1957 | Tognola | 315/46 |
| 2,900,547 | 8/1959 | Engel | 313/130 |
| 3,014,151 | 12/1961 | Segall | 313/130 |
| 3,278,785 | 10/1966 | Hauth, Jr. | 313/137 |
| 3,469,398 | 9/1969 | Schafer | 324/464 X |
| 3,854,067 | 12/1974 | Morgan | 313/130 |
| 3,883,762 | 5/1975 | Harris et al. | 313/130 |
| 3,890,518 | 6/1975 | Tombs | 313/130 |
| 4,337,408 | 6/1982 | Sone et al. | 313/130 |

*Primary Examiner*—David K. Moore
*Assistant Examiner*—Sandra L. O'Shea
*Attorney, Agent, or Firm*—William G. Auton; Donald J. Singer

[57] ABSTRACT

The prevention of electrode material erosion by undercutting in the outer electrode shell of igniter electrodes of jet engine ignition systems is prevented by the application of an electrical insulation coating. The coating is applied to the surface of the outer electrode shell which faces the ceramic insulation around the center electrode where erosion patterns are known to occur. The insulation material is selected from electrical insulation substances such as oxides of aluminum, tungsten, magnesium, beryllium or zirconium by choosing a non-porous electrical insulating substance with thermal expansion characteristics approximately equalling those of the outer electrode shell. Since a typical outer electrode shell is composed of 446 stainless steel, an optimum choice for the electrical insulation coating is $AL_2O^3$ deposited with a coating thickness of between 5 and 10 mils.

1 Claim, 4 Drawing Figures

IGNITER ELECTRODE LIFE CONTROL

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to spark plugs, and specifically to the placement of electrically insulating materials as a film or integrally bonded component of igniter electrodes for the purpose of controlling spark discharge location and electrode material erosion from spark discharges.

In today's jet engines increasing use is made of the ignition system which is energized continuously or by electronic controls, under conditions of high temperatures and pressures, for purposes of providing automatic relight in event of flameout. Energizing ignition under these conditions (while combustion is active) compresses the spark discharge into small, confined volumes within the igniter tip such that "undercutting" of the electrode shell occurs.

The task of controlling the spark discharge location and reducing electrode material erosion is alleviated, to some degree, by the following U.S. Patents, which are incorporated herein by reference:

U.S. Pat. No. 3,883,762 issued to Harris on 13 May 1975; and

U.S. Pat. No. 4,337,408 issued to Sone et al on 29 June 1982.

Harris et al show an igniter plug intended for use in an aircraft jet engine. In this patent the insulator between the center electrode firing tip and the ground electrode has semiconducting metal oxide coating formed on it.

In Sone et al an insulator is located between a recessed center electrode and an outer electrode. The Sone et al insulator carries a film which may be formed by ion plating or sputtering or plasma spraying. Disclosed compounds for film are silicon dioxide and silicon carbide.

In view of the foregoing discussion, the need remains for igniter which directs the spark discharge to prevent undercutting under active combustion conditions. The present invention is intended to satisfy that need.

SUMMARY OF THE INVENTION

This invention is directed to a novel spark plug or igniter construction used in the ignition system of a jet engine. It consists of the placement of an electrically insulating material as a film or integrally bonded component of an igniter electrode for the purpose of controlling spark discharge location and electrode material erosion in spark discharges. An insulating coating or surface layer of materials such as oxides of tungsten, alumina, and beryllium is placed by sputtering, plasma spray, etc. between the ceramic insulator and adjacent conductive surfaces of the outer electrode shell.

The function of the coating or surface insulating layer is to make the electrical discharge remain at the edge or boundary of the coating. The invention makes possible the use of today's jet engine ignition system with continuous energization or by electronic controls, under conditions of high temperatures and pressures, for purposes of providing automatic relight in the event of flameout. It avoids the "undercutting" of the electrode shell that previously occurred under these conditions (while combustion is active).

It is an object of the invention to provide an insulation coating in a jet engine igniter to direct the spark discharge.

It is another object of the present invention to reduce electrode material erosion from spark discharges.

It is another object of the present invention to prevent undercutting of the electrode shell of jet engine igniters.

These together with other objects features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention entails the placement of electrically insulating materials as a film or integrally bonded component of ignitor electrodes for the purpose of controlling spark discharge location and electrode material erosion from spark discharges in jet engine ignition systems.

Figure 1:
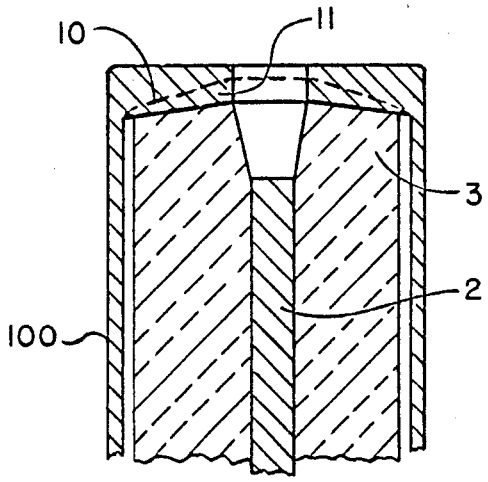
FIG. 1 is an illustration of a prior art ignition system with a homogenous alloy outer shell.
Figure 2:
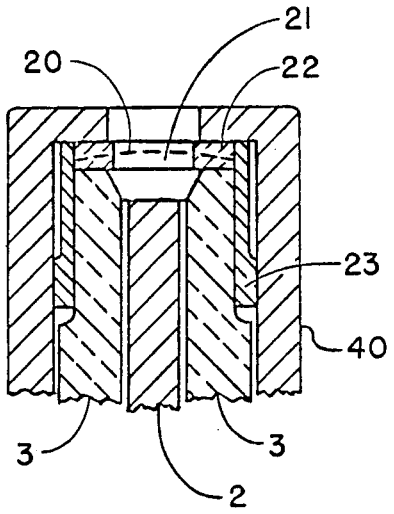
FIG. 2 is an illustration of a prior art ignition system with a washer electrode insert.
Figure 3:
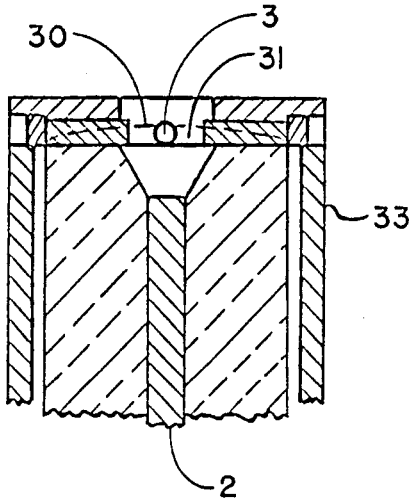
FIG. 3 is an illustration of a prior art ignition system with pin electrode inserts.

The reader's attention is now directed to FIGS. 1, 2 and 3, which represent three designs of electrode shells of jet engine ignition systems which are currently in use. FIG. 1 depicts a conventional homogenous alloy outer electrode shell 100, which surrounds a center electrode 2 and ceramic insulator 3. Sparking takes place between center electrode 2 and outer electrode 100.

Experience with jet engines has shown that a spark erosion zone 11 develops in the boundary of the outer electrode shell; continuous use of the jet engine ignition system results in an undercutting pattern 10 depicted by the dashed lines in the outer electrode shell.

FIG. 2 is an illustration of a jet igniter system with a washer outer electrode insert 22 mounted in a sleeve 23 of low expansion alloy, both of which are encased in an electrode shell 40. In this igniter, the spark erosion zone 21 and undercutting 20 affects the washer electrode insert 22 before extending to the outer electrode shell 40.

FIG. 3 is an illustration of a jet igniter system with pin electrode inserts 3 within the outer electrode shell 33. Like the systems of FIGS. 1 and 2, the use of pin electrode inserts does not prevent undercutting 30 whose pattern is depicted by the dashed lines. Similarly, the spark erosion zone 31 occurs adjacent to the electrodes. This undercutting is detrimental because it places localized electrothermal and electromechanical stresses on the ceramic insulators, and also because it can and has resulted in pieces going into the engine flow path and damaging turbine components.

Figure 4:
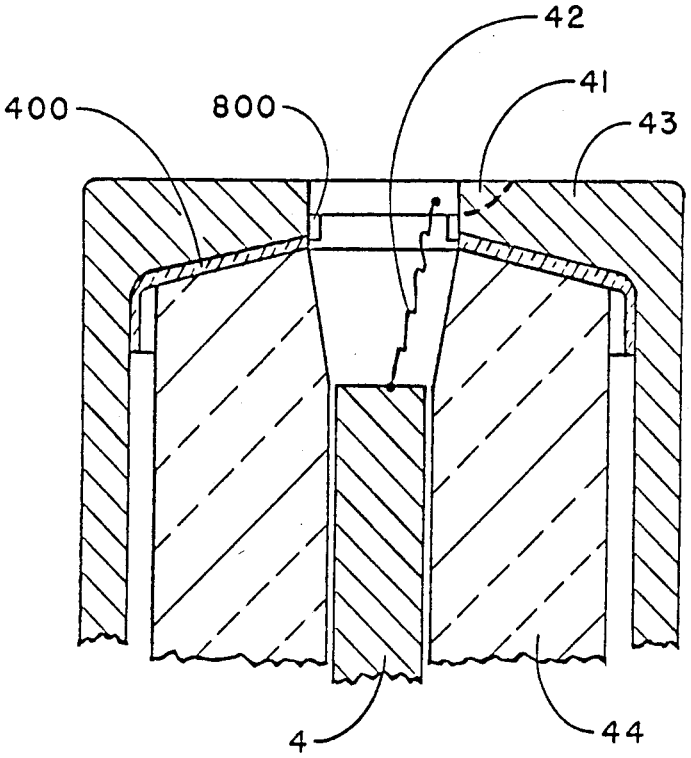
FIG. 4 is an illustration of the preferred embodiment of the present invention.

Referring to FIG. 4 this invention consists of an insulating coating or surface layer 400 added between the ceramic insulator 44 and adjacent conductive surfaces of the outer electrode shell 43, regardless of shell composition or construction, as an integral bonded portion of the outer electrode shell. The function of the coating or surface insulating layer is to make the electrical discharge remain at the edge or boundary of the coating 800 until the metallic electrically conductive material in back of the coating is eroded away by sparking, in which event the coating will then be destroyed from sparking also. The strength, adhesion, and electrical insulation properties of the coating or surface insulating layer must be sufficient so as to result in consumption of most electrode backing material prior to coating/surface layer destruction.

The insulation coating or surface layer 400 added in FIG. 4 is composed of any of numerous electrical insulating materials. In the preferred embodiment, the electrical insulation is made from oxides of: tungsten, aluminum, magnesium, zirconium or beryllium. The selection of the coating material is made by choosing a substance which possesses non-porous electrical insulation properties, and thermal expansion characteristics as close as possible to those of the outer electrode shell. Since a typical outer electrode shell will be composed of 446 stainless steel, an optimum choice for an insulation coating is $AL_2O_3$. The thickness of the insulation coating typically falls within a range of 5–10 mils. Two or more coating layers may be used, of different materials, to obtain both electrical and thermo-mechanical durability.

The insulation coating is added to the outer electrode shell 43 by placement processes of depositing substances known in the art such as sputtering, plasma spray etc. The patent of Sone et al describes an insulator with a film formed by ion plating, sputtering or plasma spraying. These placement processes are known in the art and need not be described further.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A jet engine igniter for use in combination with an ignition system for a jet engine, said jet engine igniter comprising:

a center electrode which accomplishes ignition by discharging an electrical spark to an outer electrode, a ceramic insulator which surrounds the sides of the center electrode, and an outer electrode shell of stainless steel which encompasses the ceramic insulator, and an electrical insulation coating deposited between said outer electrode shell and said ceramic insulator, said electrical insulation coating being between 5 and 10 mils in thickness and composed of oxides of tungsten, or zirconium, said electrical insulation coating thereby having thermal expansion characteristics approximately equalling those of said outer electrode shell and thereby preventing electrode material erosion and undercoating of the outer electrode shell from the electrical spark of the center electrode during use.

* * * * *